US005209310A

United States Patent [19]

Clydesdale

[11] Patent Number: 5,209,310

[45] Date of Patent: May 11, 1993

[54] COREBARREL

[75] Inventor: Graham Clydesdale, Aberdeen, Scotland

[73] Assignee: Diamant Boart Stratabit Limited, Aberdeen, Scotland

[21] Appl. No.: 759,170

[22] Filed: Sep. 13, 1991

[30] Foreign Application Priority Data

Sep. 13, 1990 [GB] United Kingdom ..... 9020038

[51] Int. Cl.[5] ..... E21B 25/00

[52] U.S. Cl. ..... 175/244; 166/325; 175/239

[58] Field of Search ..... 175/249, 240, 239, 244, 175/246; 166/325, 328, 99

[56] References Cited

U.S. PATENT DOCUMENTS 1,626,249 4/1927 Moran et al. ..... 175/239 X
3,139,142 6/1964 Chisholm et al. ..... 166/325
3,334,697 8/1967 Edwards et al. ..... 166/325 X

FOREIGN PATENT DOCUMENTS 1011823 7/1957 Fed. Rep. of Germany ..... 175/239
135051 6/1960 U.S.S.R. ..... 166/325

*Primary Examiner*—Hoang C. Dang
*Attorney, Agent, or Firm*—Ratner & Prestia

[57] ABSTRACT

A system is described which enables the safe release of formation gases when corebarrel is being raised. A corebarrel has an elongate cylindrical outer casing (1) and an elongate cylindrical liner (2), the liner (2) being disposed within the outer casing (1) such that there is a space (3) between the liner and the outer casing. The liner (2) has a plurality of unidirectional valves (4) which enable the passage of gas from the volume (5) within the liner (2) to the space (3) between the liner and outer casing, and prevent the passage of fluids from the space (3) to the volume (5).

4 Claims, 1 Drawing Sheet

COREBARREL

This invention relates to a corebarrel, particularly but not exclusively for use in high pressure wells.

BACKGROUND OF THE INVENTION

Corebarrels are used in oil and gas exploration to retrieve core samples to provide the user with information on the stratigraphy of the rock formation which is to be drilled.

Core samples are normally cylindrical sections of formation of the order of a few inches in diameter and from 30 to 90 feet in length.

In some wells at considerable depth gases may be trapped within the rock formation and become dissolved in the said formation under the extremely high pressures. As the core sample is raised out of the well the pressure on the sample reduces and any such formation gases may revaporize resulting in a positive gas pressure within the corebarrel.

Such increased pressure within the core barrel can be a considerable problem for a number of reasons. Firstly, if there is any gas impermeable layers, such as shale, above and below a layer containing pressurised gas then the gas will not be able to escape and may result in bulging of the core sample. Such bulging normally results in the core sample being stuck within the outer casing of the corebarrel. Also sudden release of the gas when the corebarrel is removed to the surface can result in explosion.

It is an object of the present invention to provide a system which enables the safe release of formation gases when the corebarrel is being raised.

SUMMARY OF THE INVENTION

According to a first aspect of the present invention there is provided a corebarrel having an elongate cylindrical outer casing and an elongate cylindrical liner, the liner being disposed within the outer casing such that there is a space between the liner and the outer casing, the liner having a plurality of unidirectional valves which enable the passage of gas from the volume within the liner to the space between the liner and outer casing, and preventing the passage of fluids from the said space to the said volume.

The unidirectional valves allow gases to vent out of core samples within the liner while preventing drilling mud, from the space between the liner and the outer casing, from entering the liner, when the corebarrel is in use.

Preferably, the unidirectional valves are spaced apart along the length of the liner and angularly spaced around the liner.

Preferably, the unidirectional valves are of a length less than or equal to the thickness of the wall of the liner so that they do not extend out of the wall.

Preferably, the liner is approximately 30 foot in length and may be coupled to one or more further liners to provide a complete liner of 60 to 90 feet in length.

Preferably, the liner is between 4" and 6 and ¾" in diameter with a wall thickness of approximately ¼".

According to a second aspect of the present invention there is provided a corebarrel liner having a plurality of unidirectional valves the liner being capable of use with a corebarrel as described above.

According to a third aspect of the present invention there is provided an unidirectional valve comprising an externally threaded plug having an internal tapered or stepped bore containing a ball bearing, retained in the bore by a retaining bar, such that pressure on one side of the ball bearing will move it so as to open a passage for gas through the plug, and pressure on the opposite side of the ball bearing will force it against the plug thus closing the passage through the plug.

Preferably the plug is approximately ⅜" in diameter and ¼" in length.

Preferably, the plug has a recessed end opposite the ball bearing which can be screwed with an Allen key.

BRIEF DESCRIPTION OF THE DRAWINGS

An embodiment of the present invention will now be described, by way of example, with reference to the accompanying drawings in which.

DESCRIPTION OF PREFERRED EMBODIMENTS

Figure 1:
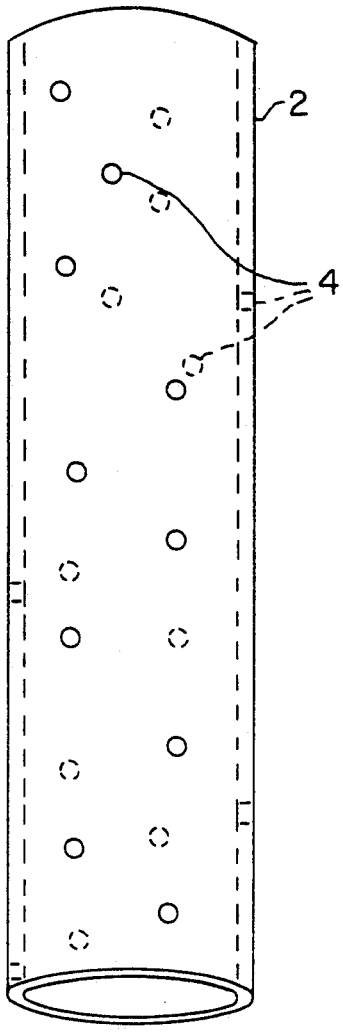
FIG. 1 is a schematic perspective view of a liner in accordance with the first and second aspects of the present invention.
Figure 2:
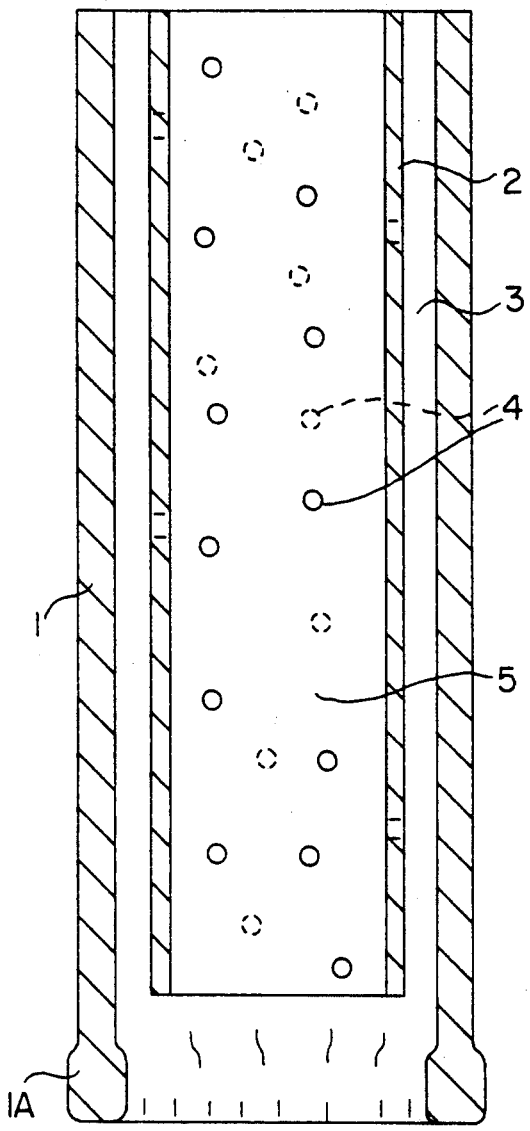
FIG. 2 is a schematic sectional front view of a liner positioned within a corebarrel outer casing.

With reference to the drawings, FIG. 2 shows a corebarrel having an elongate cylindrical outer casing 1 and an elongate cylindrical liner 2, the liner 2 being disposed within the outer casing 1 such that there is a space 3 between the liner 2 and the outer casing 1. The liner 2 has a plurality of unidirectional valves 4 each of which enables the passage of gas from the volume 5 within the liner 2 to the space 3 between the liner 2 and the outer casing 1, and preventing the passage of fluids from the said space 3 to the said volume 5.

The unidirectional valves 4 are spaced approximately 1 foot apart along the length of the liner 2 and spaced around the liner 2. The spacing around the liner 2 may be random or at a designated angular separation. An angular separation of 90 degrees has been found to be particularly suitable. The unidirectional valves are of a length of approximately ¼ of 1" which is equal to the thickness of the wall of the liner 2 such that they do not extend out of the wall.

The liner is approximately 30 foot in length and may be attached to one or more further liners 2 to provide a composite liner of 60 to 90 feet in length. The liners 2 are preferably between 4" and 6 and ¾" in diameter with a wall thickness of approximately a ¼ although liners of different dimensions may be used. The liner 2 may be disposable or may be a reusable part of the corebarrel.

Figure 3:
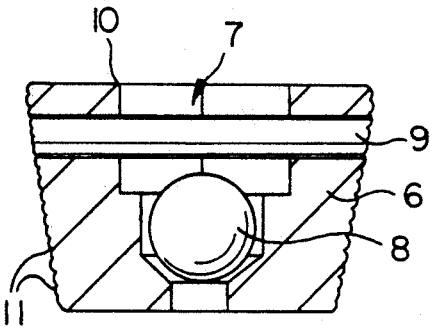
FIG. 3 is a side sectional view of a unidirectional valve in accordance with the third aspect of the present invention.
Figure 4:
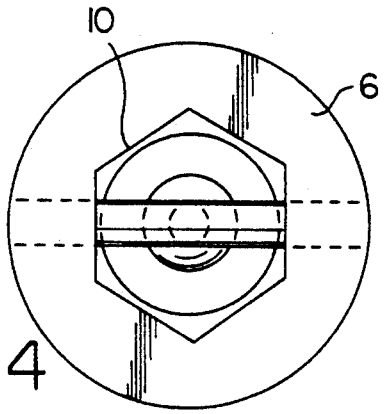
FIG. 4 is a plan view of the valve of FIG. 3.

FIGS. 3 and 4 show a unidirectional valve 4 suitable for use with the corebarrel liner 2 comprising an externally threaded plug 6 having an internal stepped bore 7 containing a ball bearing 8, the ball bearing 8 being retained in the bore 7 by a retaining bar 9. Pressure on one side of the ball bearing 8 will move the bearing so as to open a passage for gas through the plug 6 and pressure on the opposite side of the ball bearing 8 will force it against the plug 6 thus closing the passage through the plug 6.

The plug 6 has a recessed end 10 opposite the ball bearing 8 which forms a socket to be engaged with an Allen Key.

The external threading 11 allows the plug to be inserted into the liner 2.

When in use the liner 2 is positioned within the outer casing 1 and the corebarrel is lowered down the hole to the desired position where the corebarrel bit 1A proceeds to cut a core sample from the core formation. During this process drilling mud is pumped through the space 3 between the outer casing 1 and the liner 2.

When the desired core sample has been cut the corebarrel is raised out of the hole resulting in a decreased pressure on the core sample as it is raised. During this procedure formation gas may escape from the core sample through the unidirectional valves 4 from the volume 5 within the liner 2 to the space 3 between the liner 2 and the outer casing 1. Thus a dangerous build up of formation gases within the core sample as it is raised, is avoided. Drilling mud and other fluids are prevented from entering the volume 5 within the liner 2 and thus damaging the core sample by the fact that a pressure of fluid in that direction would result in the closure of the unidirectional valve 4.

Thus the formation gases within the core sample are dissipated gradually as the gases escape from the formation.

This also has the advantage that there is no change to conventional coring equipment other than the inclusion of the said valves 4. Thus the apparatus is simple to manufacture and cost effective. Also there is no restriction on normal coring operations and the valves 4 may be applied to steel or disposable corebarrel liners 2.

Improvements and modifications may be incorporated without departing from the scope of the present invention.

I claim:

1. A corebarrel having an elongate cylindrical outer casing and an elongate cylindrical liner, the liner being disposed within the outer casing such that there is a space between the liner and the outer casing, the liner comprising a cylindrical wall and having a plurality of unidirectional valves provided in said wall which enable the lateral passage of gas from the volume within the liner to the space between the liner and outer casing, and preventing the passage of fluids from the said space to the said volume.

2. A corebarrel as claimed in claim 1, wherein the unidirectional valves are spaced apart along the length of the liner.

3. A corebarrel as claimed in claim 1 or 2, wherein the unidirectional valves are angularly separated around the liner.

4. A corebarrel as claimed in claim 1, wherein the unidirectional valves are of a length less than or equal to the thickness of the wall of the liner.

* * * * *